US009068807B1

(12) United States Patent
Thomas et al.

(10) Patent No.: US 9,068,807 B1
(45) Date of Patent: Jun. 30, 2015

(54) ROCKET-PROPELLED GRENADE

(75) Inventors: Toby D. Thomas, Southlake, TX (US); Richard L. Green, Fort Worth, TX (US); Jonathan H. Record, Grand Prairie, TX (US); Robbie S. Strauch, Fort Worth, TX (US); David L. Hunn, Kennedale, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 98 days.

(21) Appl. No.: 12/914,803

(22) Filed: Oct. 28, 2010

Related U.S. Application Data

(60) Provisional application No. 61/256,258, filed on Oct. 29, 2009.

(51) Int. Cl.

| | |
|---|---|
| ***F42B 12/56*** | (2006.01) |
| ***F42B 15/10*** | (2006.01) |
| ***F42B 12/46*** | (2006.01) |
| ***F42C 14/00*** | (2006.01) |
| ***F42B 12/02*** | (2006.01) |
| ***F42B 10/02*** | (2006.01) |
| ***F42B 10/30*** | (2006.01) |

(52) U.S. Cl.
CPC ..... *F42B 15/10* (2013.01); *F42B 12/46* (2013.01); *F42C 14/00* (2013.01); *F42B 12/02* (2013.01); *F42B 10/02* (2013.01); *F42B 10/30* (2013.01)

(58) Field of Classification Search
USPC ..... 102/366, 367, 370, 498, 502, 512, 513
See application file for complete search history.

(56) References Cited

U.S. PATENT DOCUMENTS

| | | | | |
|---|---|---|---|---|
| 2,821,924 | A * | 2/1958 | Hansen et al. | 244/3.28 |
| 3,283,719 | A | 11/1966 | Grandy | |
| 3,650,213 | A | 3/1972 | Abbott et al. | |
| 3,701,533 | A * | 10/1972 | Palmer | 473/577 |
| 3,802,345 | A * | 4/1974 | La Costa | 42/78 |
| 3,865,038 | A | 2/1975 | Barr | |
| 3,940,605 | A * | 2/1976 | Gerber | 362/34 |
| 3,954,060 | A * | 5/1976 | Haag et al. | 102/494 |
| 4,326,463 | A * | 4/1982 | Burke et al. | 102/513 |
| 4,455,943 | A * | 6/1984 | Pinson | 102/489 |

(Continued)

FOREIGN PATENT DOCUMENTS

| | | | |
|---|---|---|---|
| FR | 2792399 | A1 | 10/2000 |
| WO | 2013053016 | A1 | 4/2013 |

OTHER PUBLICATIONS

Author Unknown, "Army Ammunition Data Sheets: Artillery, Ammunition, Guns, Howitzers, Mortars, Recoilless Rifles, Grenade Launchers, and Artillery Fuzes," Technical Manual 43-0001-28, Change 15, Headquarters, Department of the Army, Oct. 2006, pp. 6-11 through 6-13.

(Continued)

*Primary Examiner* — Benjamin P Lee
(74) *Attorney, Agent, or Firm* — Withrow & Terranova, PLLC

(57) ABSTRACT

A rocket-propelled grenade includes a payload section, a selectable fuzing section joined to the payload section, and a propulsion section joined to the selectable fuzing section. A rocket-propelled grenade includes a propulsion section and a payload section operably associated with the propulsion section. The payload section includes a shell, one or more penetrators disposed in the shell, and a charge for compromising the shell to deploy the one or more penetrators when the charge is initiated.

10 Claims, 17 Drawing Sheets

(56) References Cited

U.S. PATENT DOCUMENTS

| | | | | |
|---|---|---|---|---|
| 4,594,944 | A * | 6/1986 | Rongus et al. | 102/221 |
| 4,619,202 | A | 10/1986 | Romer et al. | |
| 4,638,736 | A * | 1/1987 | Farmer | 102/393 |
| 4,638,737 | A * | 1/1987 | McIngvale | 102/489 |
| 4,706,568 | A | 11/1987 | Lundwall et al. | |
| 4,777,882 | A * | 10/1988 | Dieval | 102/489 |
| 4,922,826 | A * | 5/1990 | Busch et al. | 102/489 |
| 4,957,046 | A * | 9/1990 | Puttock | 102/489 |
| 5,082,203 | A * | 1/1992 | Baubry | 244/3.28 |
| 5,119,715 | A * | 6/1992 | Porter et al. | 89/6.5 |
| 5,221,809 | A | 6/1993 | Cuadros | |
| 5,654,524 | A | 8/1997 | Saxby | |
| 5,661,257 | A * | 8/1997 | Nielson et al. | 102/334 |
| 5,796,031 | A * | 8/1998 | Sigler | 102/520 |
| 5,817,969 | A * | 10/1998 | Ettmuller | 102/489 |
| 5,880,397 | A | 3/1999 | Crilly | |
| 6,142,056 | A | 11/2000 | Taleyarkhan | |
| 6,223,658 | B1 | 5/2001 | Rosa et al. | |
| 6,269,747 | B1 * | 8/2001 | Strandli et al. | 102/334 |
| 6,393,992 | B1 | 5/2002 | Vasel et al. | |
| 6,432,715 | B1 | 8/2002 | Nelson et al. | |
| 6,523,478 | B1 * | 2/2003 | Gonzalez et al. | 102/485 |
| 6,598,534 | B2 * | 7/2003 | Lloyd et al. | 102/494 |
| 6,688,032 | B1 * | 2/2004 | Gonzalez et al. | 42/105 |
| 6,843,179 | B2 | 1/2005 | Hunn et al. | |
| 6,871,594 | B1 | 3/2005 | Estrella | |
| 6,957,609 | B2 * | 10/2005 | Ronn et al. | 102/489 |
| 6,989,525 | B2 | 1/2006 | Howard | |
| 7,032,521 | B2 * | 4/2006 | Ronn et al. | 102/489 |
| 7,060,992 | B1 | 6/2006 | Barney | |
| 7,107,910 | B2 * | 9/2006 | Hunn et al. | 102/519 |
| 7,143,698 | B2 * | 12/2006 | Lloyd | 102/489 |
| 7,261,040 | B2 * | 8/2007 | Hunn et al. | 102/495 |
| 7,278,358 | B2 | 10/2007 | Huffman | |
| 7,380,503 | B2 | 6/2008 | Williams et al. | |
| 7,490,551 | B2 * | 2/2009 | Golay et al. | 102/223 |
| 7,530,315 | B2 * | 5/2009 | Tepera et al. | 102/393 |
| 7,600,475 | B1 * | 10/2009 | Friedberg et al. | 102/265 |
| 7,743,709 | B2 | 6/2010 | Kolnik et al. | |
| 7,752,976 | B2 * | 7/2010 | Banks | 102/489 |
| 7,819,065 | B2 * | 10/2010 | Haeselich | 102/444 |
| 7,905,178 | B2 | 3/2011 | Dryer et al. | |
| 7,930,977 | B2 | 4/2011 | Klein | |
| 8,020,492 | B1 | 9/2011 | Kapeles | |
| 8,061,274 | B1 | 11/2011 | Hayes et al. | |
| 8,115,149 | B1 * | 2/2012 | Manole et al. | 244/3.14 |
| 8,196,514 | B2 * | 6/2012 | Gustafsson et al. | 102/489 |
| 8,240,252 | B2 | 8/2012 | Maljkovic et al. | |
| 8,281,720 | B2 * | 10/2012 | Dindl et al. | 102/438 |
| 8,286,557 | B2 * | 10/2012 | Endicott et al. | 102/513 |
| 8,387,538 | B2 * | 3/2013 | Elder | 102/477 |
| 8,415,598 | B1 * | 4/2013 | Terhune et al. | 244/3.28 |
| 8,464,639 | B2 * | 6/2013 | Thomas et al. | 102/275.9 |
| 8,511,231 | B2 | 8/2013 | Hayes et al. | |
| 8,616,127 | B2 * | 12/2013 | Aliaghai et al. | 102/254 |
| 8,661,981 | B2 * | 3/2014 | Tepera et al. | 102/495 |
| 8,708,285 | B1 * | 4/2014 | Carreiro | 244/190 |
| 2002/0174794 | A1 | 11/2002 | Lowden et al. | |
| 2005/0016412 | A1 | 1/2005 | Vasel et al. | |
| 2005/0188886 | A1 | 9/2005 | Vasel et al. | |
| 2006/0196382 | A1 * | 9/2006 | Golay et al. | 102/229 |
| 2007/0068414 | A1 | 3/2007 | O'Dwyer et al. | |
| 2009/0013893 | A1 | 1/2009 | Vasel et al. | |
| 2010/0000438 | A1 | 1/2010 | Dryer et al. | |
| 2010/0275807 | A1 | 11/2010 | Landry et al. | |
| 2011/0056402 | A1 * | 3/2011 | Gustavsson et al. | 102/440 |
| 2011/0067593 | A1 * | 3/2011 | Klein | 102/439 |
| 2011/0203475 | A1 | 8/2011 | Thuman | |
| 2011/0233426 | A1 | 9/2011 | Carroll et al. | |
| 2012/0006218 | A1 * | 1/2012 | Dietrich | 102/374 |
| 2012/0006219 | A1 * | 1/2012 | Dietrich | 102/376 |
| 2012/0180686 | A1 * | 7/2012 | Jones et al. | 102/365 |
| 2012/0227614 | A1 * | 9/2012 | Sullivan | 102/513 |
| 2013/0087063 | A1 | 4/2013 | Halter | |
| 2014/0025328 | A1 | 1/2014 | Burns et al. | |
| 2014/0041545 | A1 * | 2/2014 | Aw et al. | 102/513 |

OTHER PUBLICATIONS

Author Unknown, "Flight controlled Mortar (FCMortar)," Request for Information, Solicitation No. N0017813Q1010, Posted Mar. 27, 2013, Naval Surface Warfare Center, Dahlgren, Virginia, 7 pages.

Henderson, Milton E., Jr., "Fuze Efforts," AMRDEC, Weapons Development and Integration Directorate, Systems & Warheads Function, (RDMR-WDP-S), May 7, 2012, Control # FN5850, 15 pages.

Sandia National Laboratories et al., "Variable Range Less-Than-Lethal Ballistics," Final Report to the National Institute of Justice on Grant No. 2000-LT-BX-K004, Document No. 199046, U.S. Department of Justice, Jan. 2003, 66 pages.

Singh, Anant, "Degradable Taggants & Automated Multi-platform Sensor for Intelligence, Surveillance and Reconnassaince," Narrative Briefing, Command: ONR—SBIR, Topic: N07-072, TIAX LLC, 2010, Lexington, Massachusetts, 6 pages.

Non-Final Office Action for U.S. Appl. No. 13/296,408, mailed Mar. 22, 2013, 9 pages.

Final Office Action for U.S. Appl. No. 13/296,408, mailed Oct. 21, 2013, 10 pages.

Final Office Action for U.S. Appl. No. 13/296,408, mailed Feb. 10, 2014, 14 pages.

Applicant-Initiated Interview Summary for U.S. Appl. No. 13/296,408, mailed Mar. 26, 2014, 3 pages.

Advisory Action for U.S. Appl. No. 13/296,408, mailed May 1, 2014, 3 pages.

Notice of Allowance for U.S. Appl. No. 13/296,408 mailed Mar. 19, 2015, 8 pages.

Non-Final Office Action for U.S. Appl. No. 14/198,721, mailed Feb. 26, 2015, 8 pages.

Non-Final Office Action for U.S. Appl. No. 14/198,732, mailed May 6, 2015, 14 pages.

* cited by examiner

ROCKET-PROPELLED GRENADE

CROSS-REFERENCE TO RELATED APPLICATIONS

This application claims the benefit of U.S. Provisional Patent Application No. 61/256,258; filed 29 Oct. 2009; and entitled "Grenade," which is hereby expressly incorporated herein by reference for all purposes.

BACKGROUND

1. Field of the Invention

The present invention relates generally to rocket-propelled grenades.

2. Description of Related Art

Modern urban warfare presents warfighters with many different combat scenarios. For example, it is generally desirable and often more effective to use non-lethal means to control opposing combatants. One technique that is not available to current-day warfighters is to temporarily visually impair opposing combatants or other unruly persons. Attempts have been made to utilize "star shells," which fire a phosphorus-based flare into the air; however, such shells fail to provide light that is of sufficient intensity to be effective.

In military or police crowd control situations, and particularly in riot or violent confrontations involving large numbers of people, it is often desirable but impractical to identify all participants. Members of such mobs will disperse unless physically restrained and current technology provides no way to easily identify a person at a later time that was involved in the confrontation or riot.

In yet another example, it is often necessary or at least desirable for warfighters to open a breach in a building wall so that the building can be secured. It is often very desirable to open a series of breaches in adjacent building walls so that the warfighters can move from one building to the next, thus avoiding streets and other open areas where they would likely be exposed to lethal weapons fire from adversaries. Conventionally, warfighters use standard-issue explosives, such as C-4 plastic explosives and the like, or anti-tank rockets, such as AT-4 anti-tank rockets and the like, to create the needed breaches. Explosives, however, require special handling, detonators, and techniques for use. Failure to use such explosives properly can result in accidents that are lethal to nearby warfighters. While anti-tank rockets can be effective, such rockets are expensive due to their particular characteristics. Some such rockets can cost many thousands of dollars each and are, therefore, not cost effective for breaching walls.

There are many tools available to the warfighter for dealing with enemy combatants, participants in riots, and the like, as well as for breaching building walls, well known in the art, however, considerable shortcomings remain.

DESCRIPTION OF THE DRAWINGS

The novel features believed characteristic of the invention are set forth in the appended claims. However, the invention itself, as well as, a preferred mode of use, and further objectives and advantages thereof, will best be understood by reference to the following detailed description when read in conjunction with the accompanying drawings, wherein:

Figure 1:
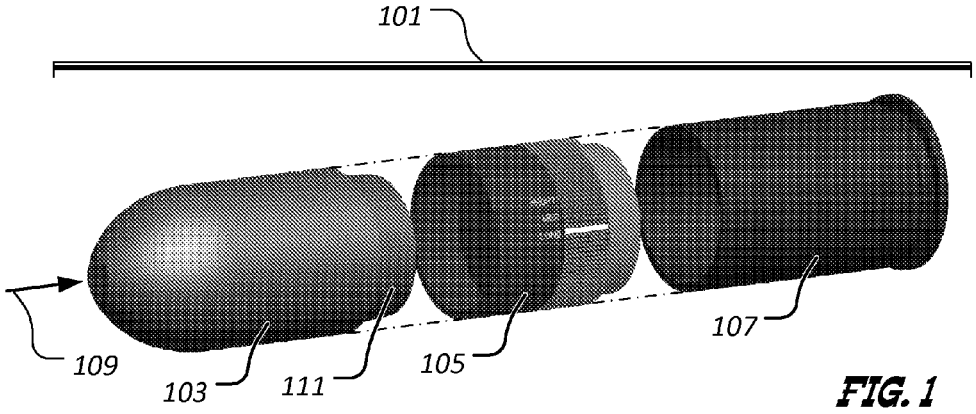
FIG. 1 is a partially exploded, perspective view of a first illustrative embodiment of a rocket-propelled grenade.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

Reference will now be made in detail to the present exemplary embodiments of the invention, examples of which are illustrated in the accompanying drawings.

Figure 2:
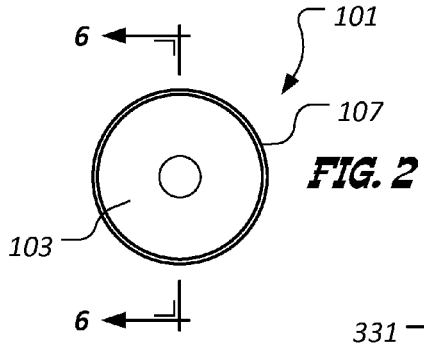
FIG. 2 is an end, elevational view of the grenade embodiment of FIG. 1.

FIG. 1 depicts a partially exploded, perspective view of a first illustrative embodiment of a rocket-propelled grenade 101. FIG. 2 depicts an end, elevational view of grenade 101, looking in a direction corresponding to an arrow 109 of FIG. 1. While the present invention contemplates many various sizes, gages, calibers, and the like, grenade 101 is a 40 mm grenade in one embodiment. In some implementations, grenade 101 is fired from a weapon, such as a grenade launcher. In the illustrated embodiment, grenade 101 comprises a payload section 103, a selectable fuzing section 105, and a propulsion section 107. Payload section 103 is joined to selectable fuzing section 105, which is joined to propulsion section 107. Generally, combustion produced in propulsion section 107 activates one of a plurality of fuzes in selectable fuzing section 105, which, in turn, activates a payload of payload section 103. Each of the plurality of fuzes of fuzing section 105 exhibit different burn rates, thus changing the elapsed time between ignition of the particular fuze utilized and activation of the payload.

Figure 3:
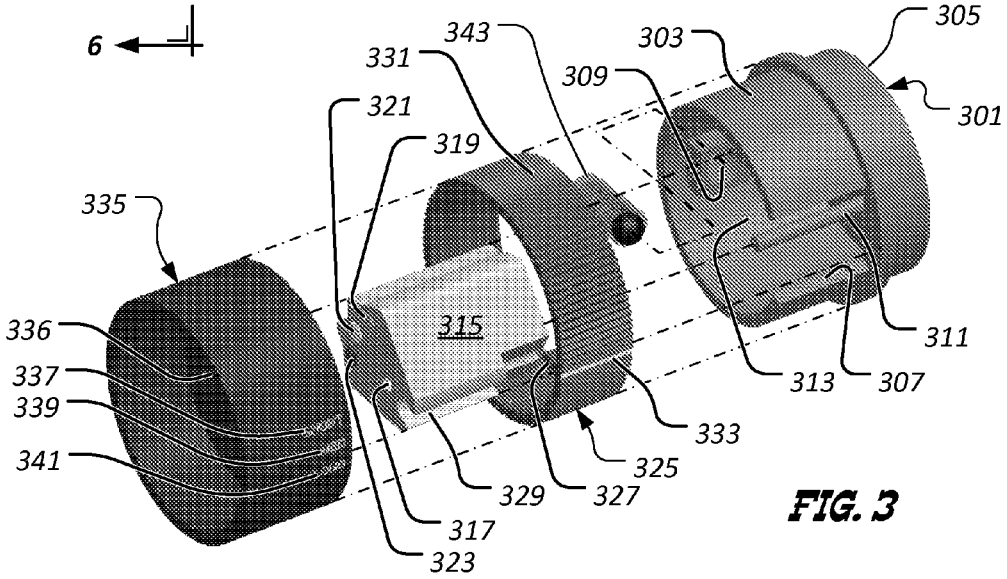
FIG. 3 is a partially exploded, perspective view of a selectable fuzing section of the grenade embodiment of FIG. 1.
Figure 4:
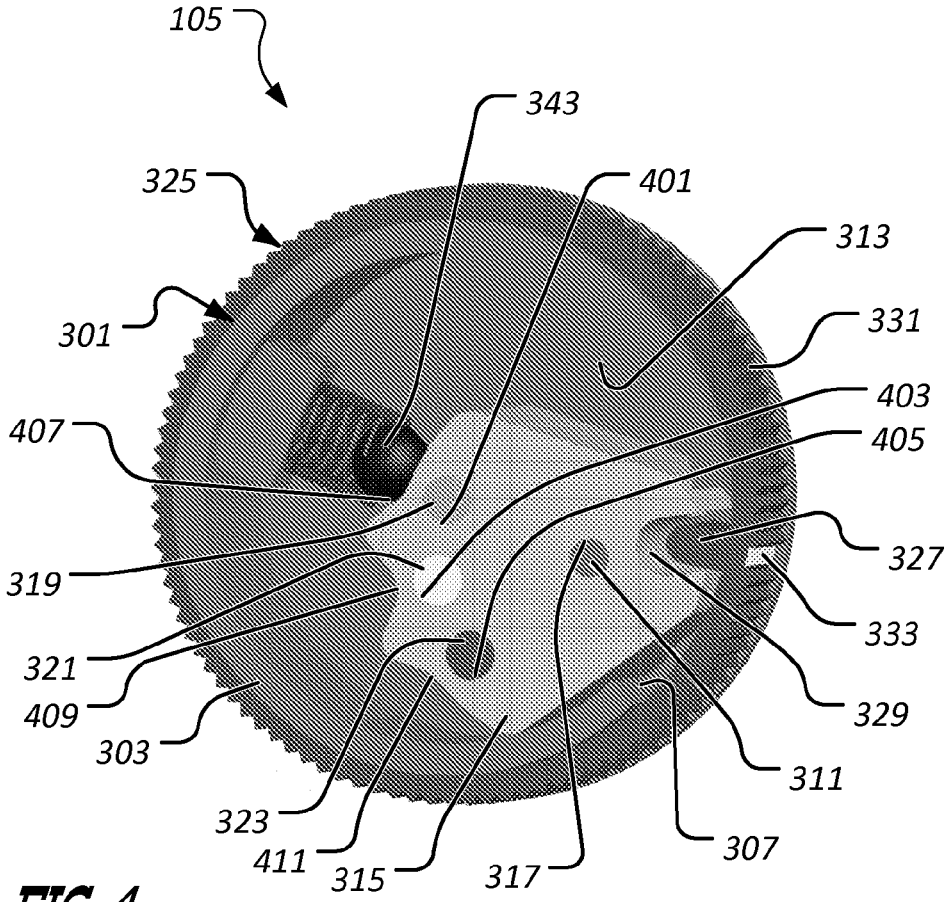
FIG. 4 is an end, perspective view of the selectable fuzing section of FIG. 3.

FIG. 3 is a partially exploded, perspective view of selectable fuzing section 105. In the illustrated embodiment, selectable fuzing section 105 comprises a housing 301 comprising a flange 303 extending from an end wall 305, which defines a passageway 601 (not shown in FIG. 3 but shown in at least FIG. 6) and which is discussed in greater detail herein. Flange 303 defines a notch 307 and an opening 309. A shaft 311 also extends from end wall 305 into a cavity 313 defined by flange 303 and end wall 305. Selectable fuzing section 105 further comprises a selector cam 315 defining a bore 317. Selector cam 315 is disposed in cavity 313, such that shaft 311 is received in bore 317 and selector cam 315 is rotatable about shaft 311. Selector cam 315 further defines a plurality of bores 401, 403, and 405, shown best in FIG. 4, in which a corresponding plurality of fuzes 319, 321, and 323 are disposed. Each of fuzes 319, 321, and 323 exhibits a unique burn rate. In at least some embodiments, one or more of fuzes 319, 321, and 323 comprises a pyrotechnic fuze material. Such materials may include compounds of sulfur, silicon, tungsten, and/or boron. Pyrotechnic delays are used to control the time of events from the initiation of an initial impulse to the initiation of a secondary impulse, or output. Generally, the delay is initiated by a thermal energy input. Timing is achieved by the linear reaction rate of a column of the pyrotechnic material. Selectable fuzing section 105 further comprises a selector ring 325 defining an inwardly-projecting tab 327. Selector ring 325 is disposed about flange 303 of housing 301, such that tab 327 is disposed in notch 307 and is received in a groove 329 defined by selector cam 315. An outer surface 331 of selector ring 325 preferably ridged, knurled, or the like to aid in rotating selector ring 325 and further provides an indicator 333, such as a line, a mark, or the like. Selectable fuzing section 105 further comprises a cover 335, which is partially received on and affixed to flange 303 and an aft protrusion 111 of payload section 103 to couple payload section 103 and fuzing section 105, and to cover components disposed within cavity 313 of housing 301. Cover 335 includes an internal wall 336, which defines a passageway 503 (not shown in FIG. 3 but shown in at least FIGS. 5 and 6) and which is discussed in greater detail herein. Cover 335 preferably further includes a plurality of markings 337, 339, and 341, corresponding to the plurality of fuzes 319, 321, and 323. As best shown in FIG. 4, selector cam 315 further defines a plurality of valleys 407, 409, and 411, corresponding to the plurality of fuzes 319, 321, and 323. Selectable fuzing section 105 further comprises a spring plunger 343, which is disposed in opening 309 and is threadedly engaged with flange 303 in the illustrated embodiment. Spring plunger 343 extends into cavity 313 and biasingly abuts selector cam 315 to selectively retain selector cam 315 in a desired rotational position.

Figure 5A:
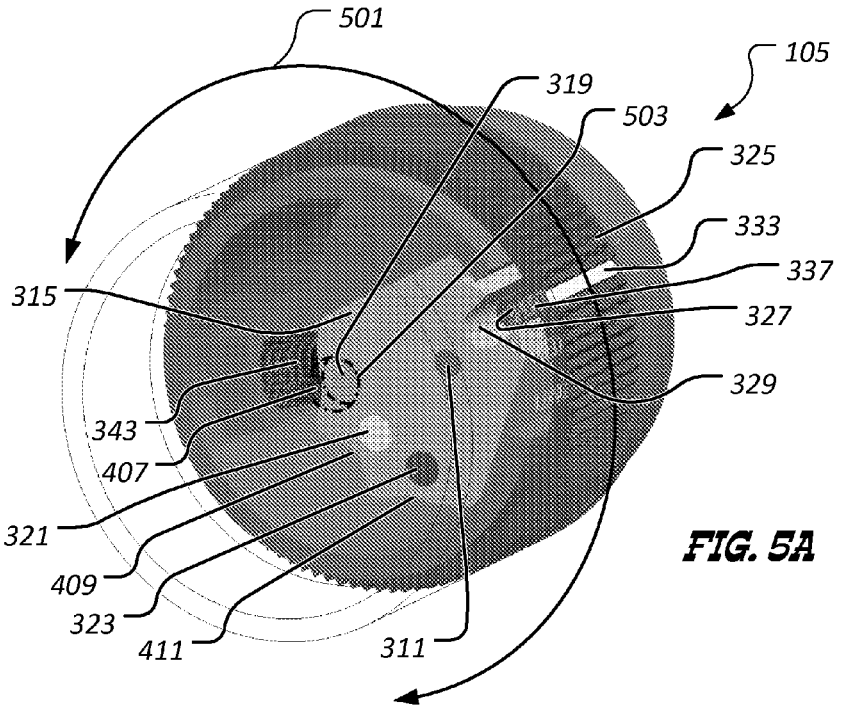
FIGS. 5A-5C are end, perspective views of the selectable fusing section of FIG. 3, depicting an exemplary operation of the selectable fuzing section.
Figure 5B:
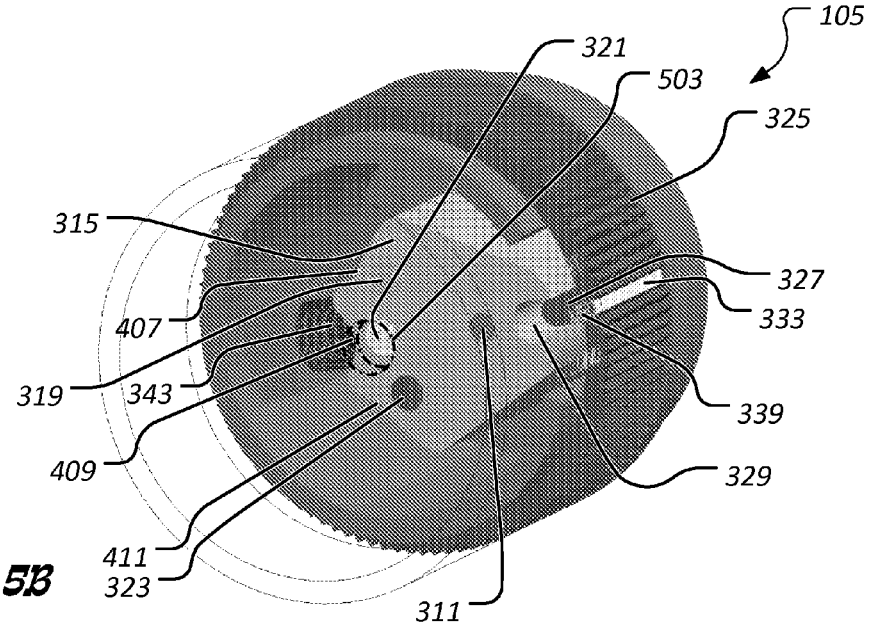
Figure 5C:
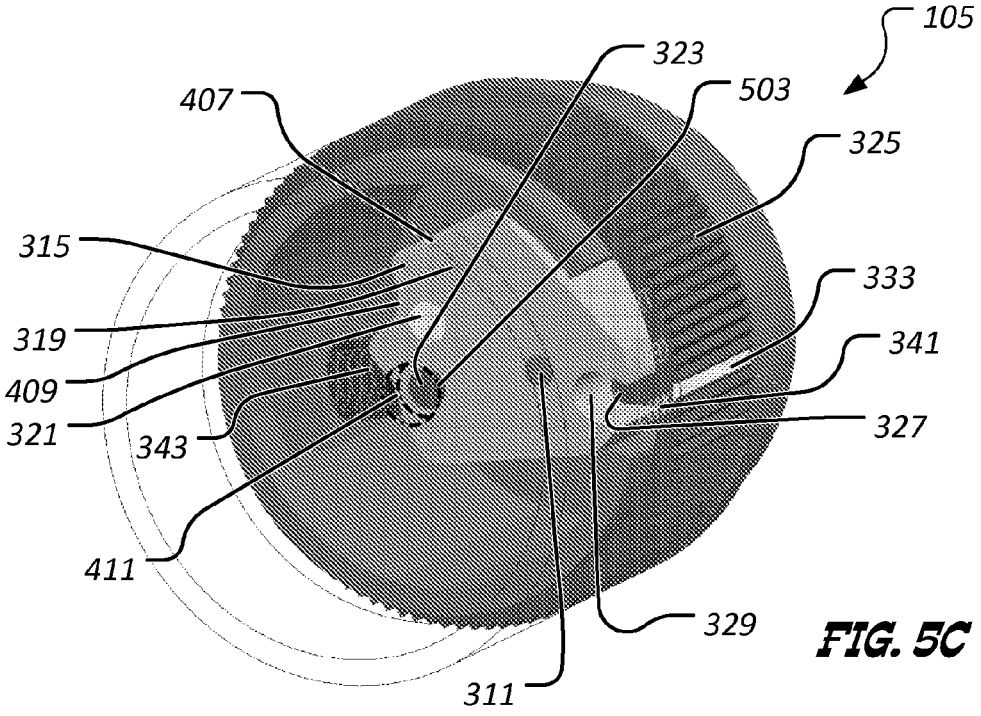

FIGS. 5A-5C show an exemplary operation of the embodiment of fuzing section 105 shown in FIGS. 3 and 4. Rotating selector ring 325, as indicated by a double-headed arrow 501, causes selector cam 315 to rotate about shaft 311, as tab 327 of selector ring 325 is disposed in groove 329 of selector cam 315. Spring plunger 343 is biased against selector cam 315 and, as selector ring 325 and selector cam 315 are rotated, spring plunger 343 seeks one of valleys 407, 409, and 411 in which to rest, thus rotationally locating selector cam 315 in one of a plurality of positions corresponding to the plurality of fuzes 319, 321, and 323. For example, FIG. 5A shows selector cam 315 in a first position, while FIGS. 5B and 5C show selector cam 315 is second and third positions, respectively. When selector cam 315 is in the first position, fuze 319 is generally aligned with a passageway 601 (not shown in FIGS. 5A-5C but shown in at least FIG. 6) defined by end wall 305 of housing 301. Fuze 319 is also generally aligned with a passageway 503, (shown in phantom in FIGS. 5A-5C but best shown in at least FIG. 6) defined by cover 335. Passageways 503 and 601 are discussed in greater detail herein with reference to FIG. 6. Moreover, when selector cam 315 is in the first position, indicator 333 is positioned adjacent first marking 337. Similarly, when selector cam 315 is in the second position, as shown in FIG. 5B, fuze 321 is generally aligned with passageways 503 and 601, and indicator 333 is positioned adjacent second marking 339. When selector cam 315 is in the third position, as shown in FIG. 5C, fuze 323 is generally aligned with passageways 503 and 601, and indicator 333 is positioned adjacent third marking 341. The present invention contemplates any plurality of fuzes, such as fuzes 319, 321, and 323; any corresponding plurality of markings, such as markings 337, 339, and 341; and corresponding structure to hold and operate the plurality of fuzes.

Figure 6:
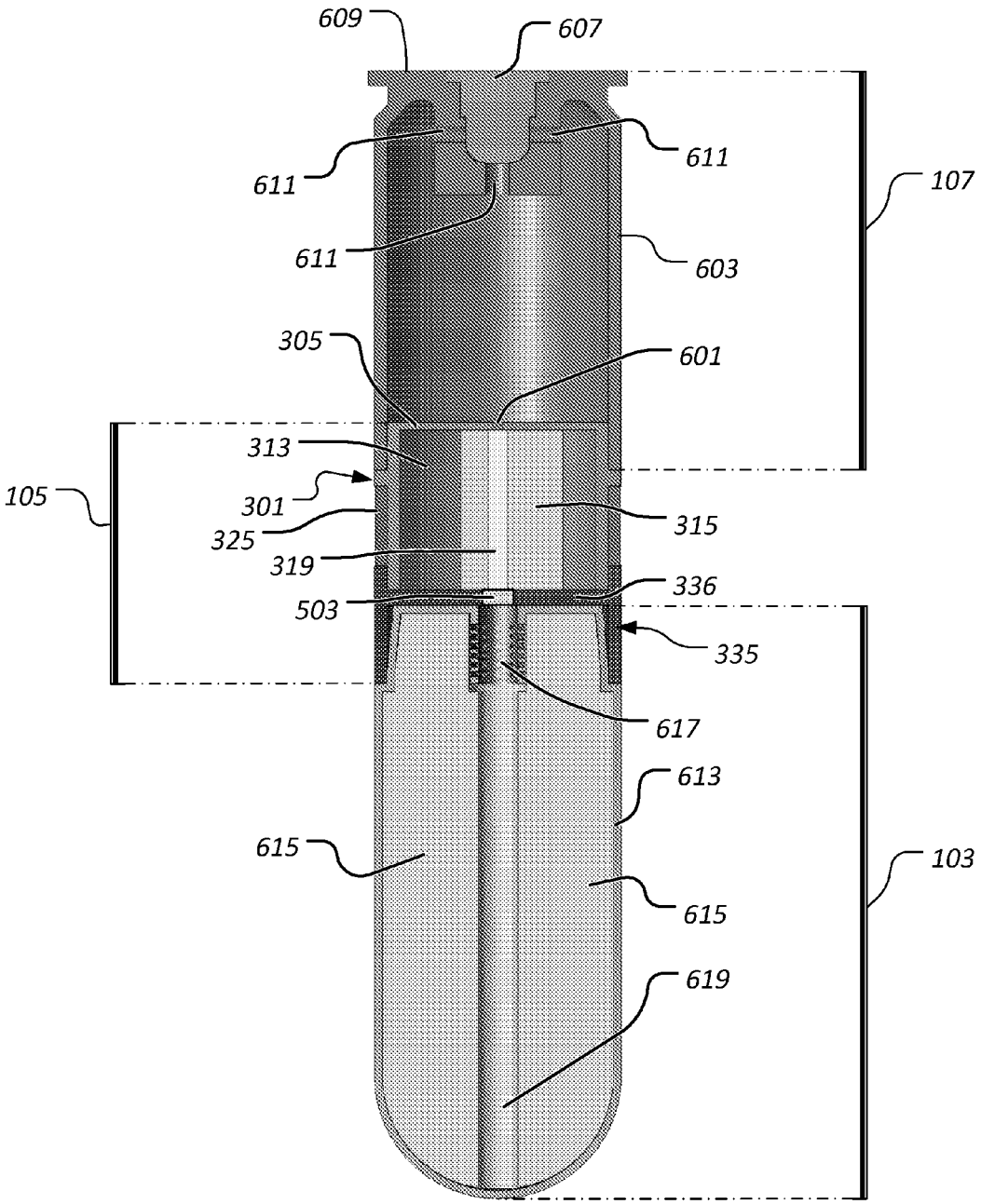
FIG. 6 is a cross-sectional view of the grenade of FIG. 1, taken along the line 6-6 in FIG. 2, depicting a first illustrative payload section embodiment.

FIG. 6 depicts a cross-sectional view, taken along the line 6-6 in FIG. 2, of the embodiment of grenade 101 illustrated in FIGS. 1 and 2. In the illustrated embodiment, propulsion section 107 comprises a casing 603 affixed to housing 301 and a firing charge 607. Exemplary firing charges 607 include, but are not limited to, a Federal 215 percussion primer and an M2 firing charge, such as used in the U.S. M430A1 40 mm grenade, or the like. Firing charge 607 is disposed at an aft end 609 of casing 603. Casing 603 defines one or more ports 611 extending from firing charge 607. When firing charge 607 is initiated, rapidly expanding gases cause casing 603 to separate from housing 301, and selectable fuzing section 105 and payload section 103 are propelled through the air. Heat generated by the initiated firing charge 607 propagates through passageway 601 of housing 301 to initiate the particular fuze generally aligned therewith, such as fuze 319, 321, or 323. In the particular configuration shown in FIG. 6, fuze 319 is generally aligned with passageway 601; however, any of fuzes 319, 321, or 323 may be selected to be generally aligned with passageway 601 in the illustrated embodiment. The fuze, for example fuze 319 in FIG. 6, generally aligned with passageway 601 is consumed over a period of time and, when fully consumed or about fully consumed, heat is propagated from the fuze through passageway 503 defined by internal wall 336 of cover 335 to activate the payload of payload section 103.

It should be noted that the present invention contemplates many various payloads of payload section 103. In the embodiment illustrated in FIG. 6, payload section 103 comprises a shell 613 in which an energetic material 615 is disposed. Energetic material 615 emits light when initiated. The emitted light may be visible by humans and may be of a high intensity. Alternatively, the visible light may be invisible to the naked eye, such as light exhibiting wavelengths in the infrared or near-infrared spectra. Energetic material 615 in at least some embodiments comprises an intermetallic energetic material, for example, a metastable, intermolecular composite material. Such materials are formulations of nano-powders that exhibit thermitic behavior and are a subclass of materials known as "thermites." Examples of such materials include, but are not limited to, formulations of aluminum/molybdenum trioxide, aluminum/tetrafluoroethylene, aluminum/copper oxide, and the like. Payload section 103 further comprises an igniter 617, operably associated with passageway 503 defined by internal wall 336 of cover 335, for initiating energetic material 615. In the Illustrated embodiment, a passageway 619 extends through at least a portion of energetic material 615 to aid in initiating energetic material 615. Specifically, when heat from the consumed fuze, such as fuze 319 in the illustrated embodiment, propagates through passageway 503, igniter 617 is activated, which, in turn, initiates energetic material 615. When energetic material 615 is initiated, shell 613 is structurally compromised, thus releasing the initiated energetic material 615 into the air.

Figure 7:
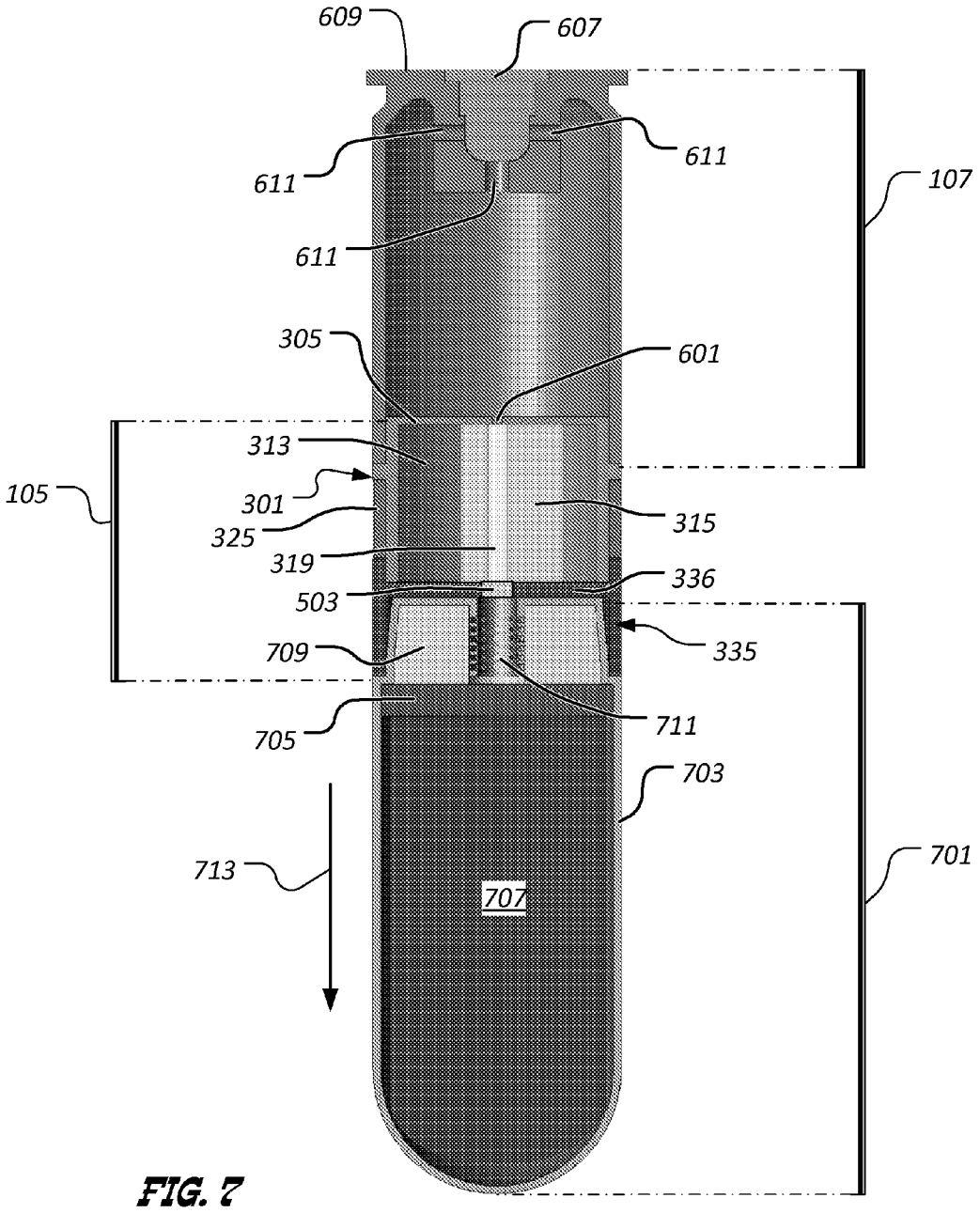
FIG. 7 is a cross-sectional view of the grenade of FIG. 1, taken along the line 6-6 in FIG. 2, depicting a second illustrative payload section embodiment.

FIG. 7 depicts a cross-sectional view of an embodiment of grenade 101 including a payload section 701 that is alternative to payload section 103. Other elements of the embodiment of grenade 101 shown in FIG. 7, that is elements of propulsion section 107 and selectable fuzing section 105, as well as the operation of such elements, are generally equivalent to the corresponding elements shown in FIGS. 3, 4, 5A-5C, and 6. In the illustrated embodiment, payload section 701 comprises a shell 703 housing a wad 705 separating a dye material 707 and a propulsive, energetic material 709. In one embodiment, dye material 707 is a generally transparent, permanent dye that fluoresces when exposed to ultraviolet light. Dye material 707 may comprise, for example, triazinyl stilbene-based invisible ink, such as triazinyl stilbene-based blue invisible ink. Moreover, dye material 707 may include type DFSB-C7 clear red fluorescent solvent-based dye, type DFWB0K412-50 clear blue fluorescent dye, type IF2-C2 clear yellow fluorescent ink, or IF2C6 clear green fluorescent ink, each provided by Risk Reactor of Dallas, Oreg., US. Furthermore, dye material 707 may include Tracerline clear blue fluorescent dye, such as type TP-3920 fluorescent dye, provided by Tracer Products of Westbury, N.Y., US. In other embodiments, dye material 707 may include series T-800 or T-900 water-based tracer, provided by Black Light World of Cub Run, Kentucky, US. Payload section 701 further includes an initiator 711 operably associated with passageway 503 defined by internal wall 336 of cover 335 and propulsive, energetic material 709. When heat from the consumed fuze, such as fuze 319 in the illustrated embodiment, propagates through passageway 503, initiator 711 is activated, which, in turn, initiates energetic material 709. When energetic material 709 is initiated, wad 705 is propelled forward, generally corresponding to an arrow 713, which compromises shell 703, thus dispersing dye material 707 into the air. It should also be noted that the present invention contemplates embodiments wherein dye material 707 is replaced with or is combined with one or more of radio frequency detectable particles, radioactive emission detectable particles, and visual wavelength detectable particles or dyes.

Figure 8:
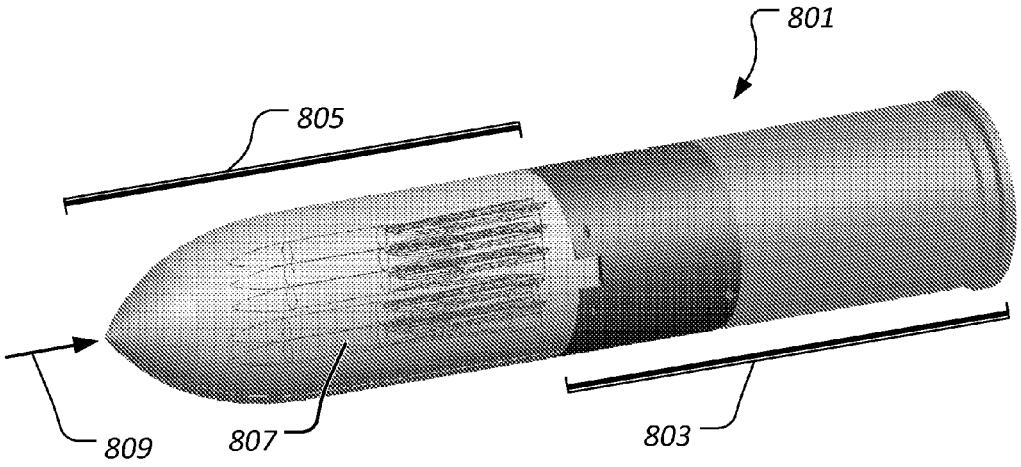
FIG. 8 is a perspective view of a second illustrative embodiment of a rocket-propelled grenade.
Figure 9:
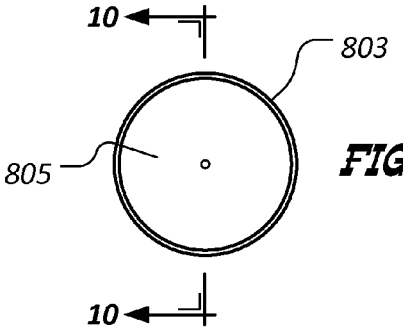
FIG. 9 is an end, elevational view of the grenade embodiment of FIG. 8.

FIG. 8 depicts a perspective view of a second illustrative embodiment of a rocket-propelled grenade 801. FIG. 9 depicts an end, elevational view of grenade 801, looking in a direction corresponding to an arrow 809 of FIG. 8. In the illustrated embodiment, grenade 801 comprises a propulsion section 803 joined to a payload section 805. Payload section 805 includes one or more penetrators 807 disposed therein. In various embodiments, one or more of the penetrators 807 may have configurations corresponding to one of the penetrator embodiments disclosed in commonly-owned U.S. Pat. No. 6,843,179, entitled "Penetrator and Method for Using Same," which is incorporated herein by reference for all purposes. The one or more penetrators 807 are propelled toward a target, such as a building wall or the like, to breach the target. While the present invention contemplates many various sizes, gages, calibers, and the like, grenade 801 is a 40 mm grenade in one embodiment. In some implementations, grenade 801 is fired from a weapon, such as a grenade launcher.

Figure 10:
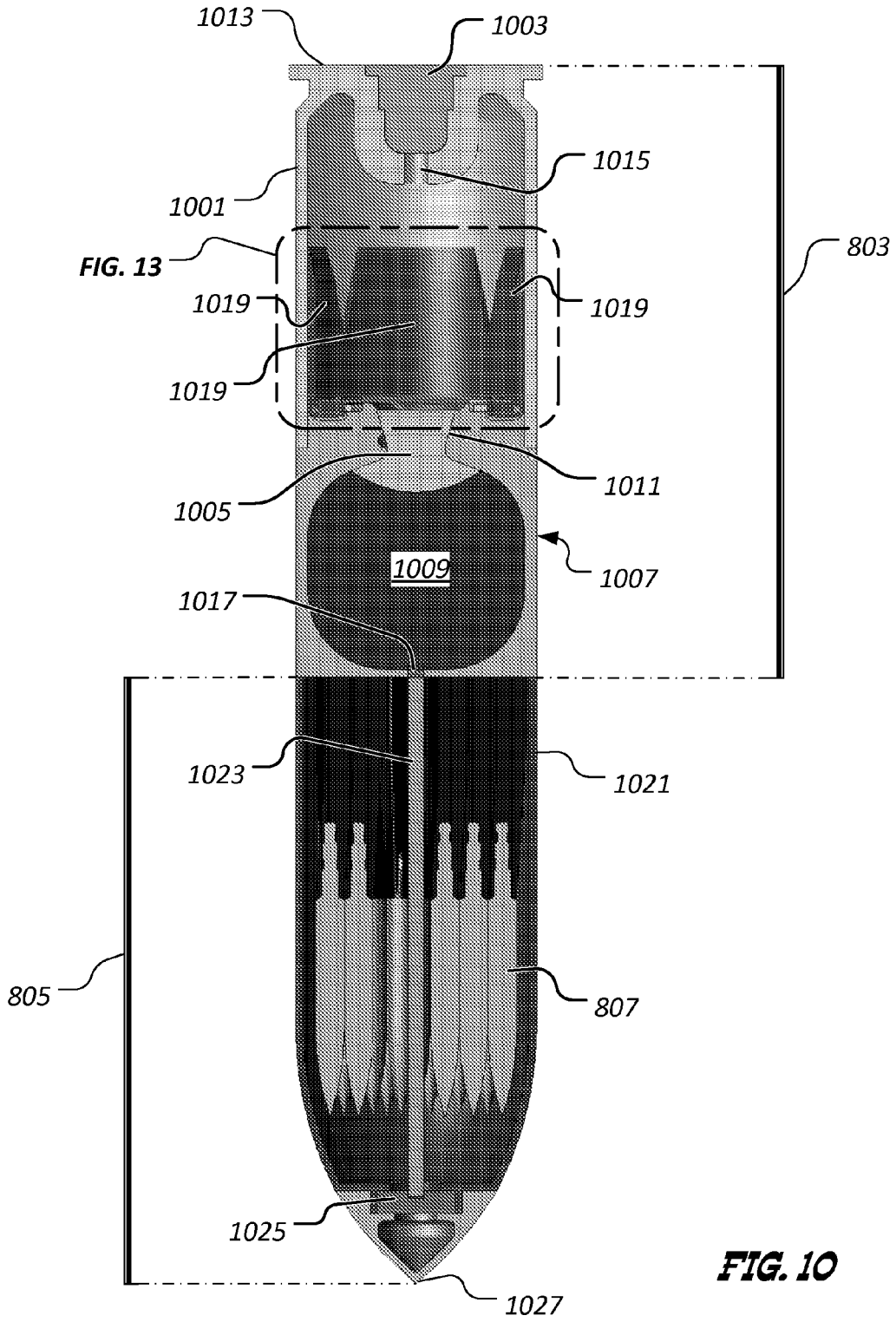
FIG. 10 is a cross-sectional view of the grenade embodiment of FIG. 8, taken along the line 10-10 in FIG. 9.

FIG. 10 depicts a cross-sectional view of grenade 801, taken along the line 10-10 in FIG. 9. Propulsion section 803, in the illustrated embodiment, comprises a casing 1001, a firing charge 1003, a slow-burn igniter 1005, a propellant housing 1007 to which casing 1001 is affixed, and a booster propellant 1009. Slow-burn igniter 1005 and booster propellant 1009 are disposed in propellant housing 1007, which defines a nozzle 1011. Firing charge 1003 is disposed at an aft end 1013 of casing 1001. Casing 1001 defines one or more ports 1015 leading from firing charge 1003 in communication with slow-burn igniter 1005. Firing charge 1003 is operatively associated with slow-burn igniter 1005 via the one or more ports 1015 for initiating slow-burn igniter 1005. When fired, the rapidly expanding gases produced by the firing charge 1003 cause casing 1001 to separate from propellant housing 1007 and initiate slow-burn igniter 1005. When initiated, slow-burn igniter 1005 burns at a slow rate, such as In at least some embodiments slow-burn igniter 1005 is a functionally graded propellant. The particular burn rate characteristics of slow-burn igniter 1005 are implementation specific. Due to formulation variation in specific directions of such a material, the combustion and mechanical behavior of a given functionally graded propellant is also a function of the perpendicular distance to the burning surface. Desired burn rate control can be achieved, for example, by variations in propellant composition and particle size distribution. For example, by introducing different amounts and shapes of aluminum particles, e.g., micron aluminum flake vs. nano-sized aluminum rods vs. nano-sized spherical aluminum particles, the burning rate of the propellant can vary by several hundred percent. After being consumed or at least partially consumed, slow-burn igniter 1005 ignites booster propellant 1009, which propels booster propellant housing 1007 and payload section 805 through the air. Heat generated by the burning booster propellant 1009 propagates through a passageway 1017 defined by propellant housing 1007 to activate payload section 805.

Figure 11:
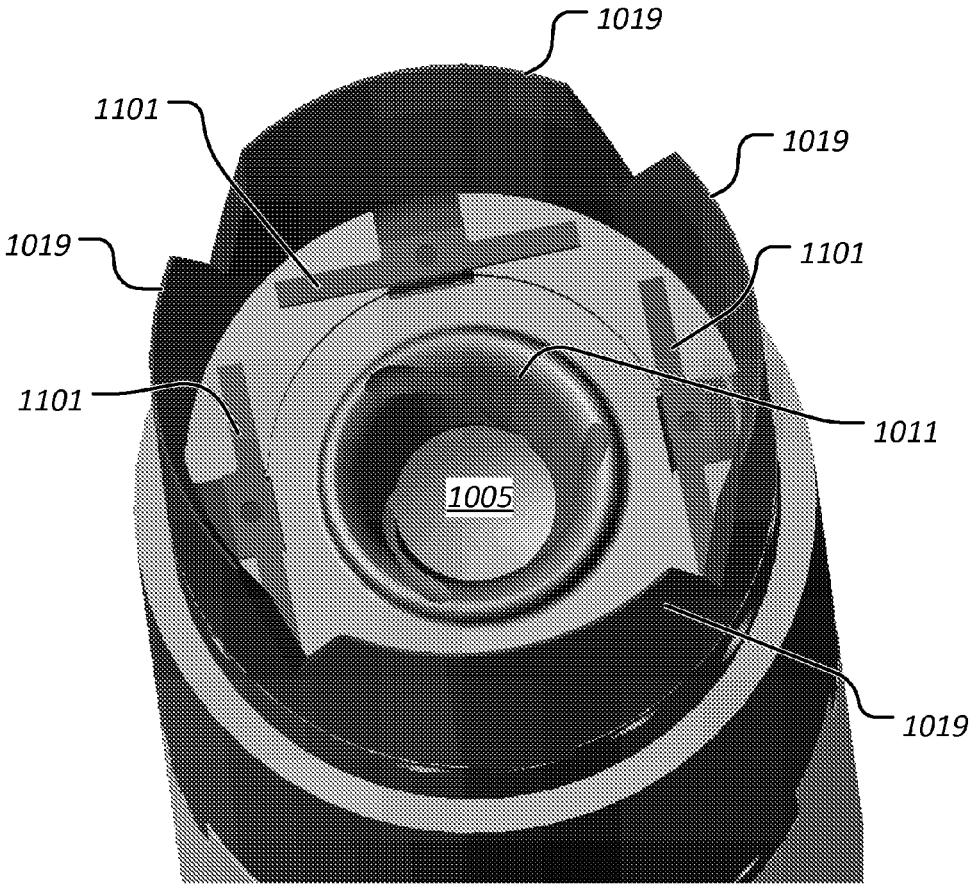
FIGS. 11 and 12 are end, perspective views of the grenade embodiment of FIG. 8.

Still referring to FIG. 10, grenade 801 further comprises a plurality of fins 1019 pivotably attached to propellant housing 1007. In the illustrated embodiment, grenade 801 comprises four fins 1019; however, the scope of the present invention encompasses any suitable number of fins 1019. The plurality of fins 1019 are held in a folded, undeployed configuration by casing 1001 until casing 1001 is separated from propellant housing 1007. Attention is drawn now to FIG. 11, which is a perspective view of the aft end of grenade 801 in which casing 1001 has been removed to more clearly show particular aspects of grenade 801. Note that the plurality of fins 1019 is shown in the folded, undeployed configuration. Grenade 801 comprises a plurality of biasing elements 1101 corresponding to the plurality of fins 1019. One biasing element 1101 is operatively associated with each fin 1019. Note that, in FIG. 11, only three biasing elements 1101 are shown, as one biasing element 1101 is hidden by one of the plurality of fins 1019. Biasing elements 1101 bias fins 1019 into an open configuration when casing 1001 is separated from propellant housing 1007, as shown in FIG. 12.

Figure 12:
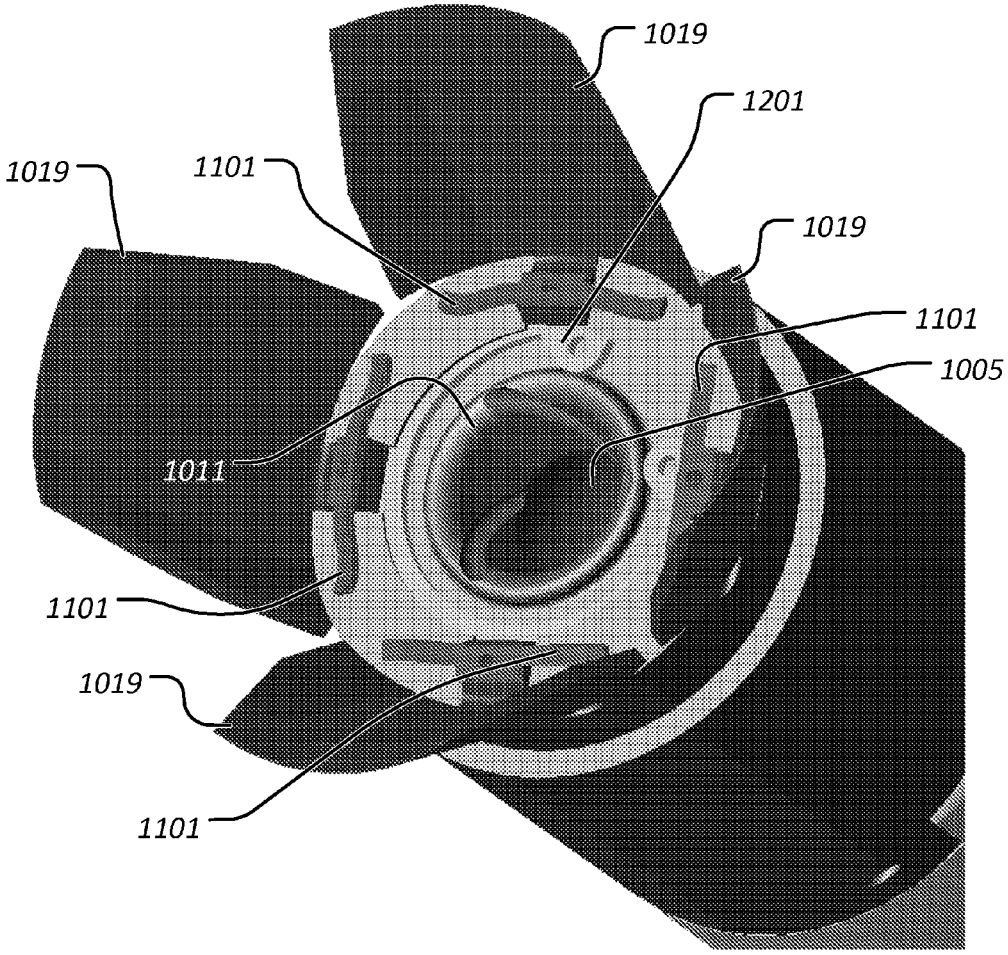
Figure 13:
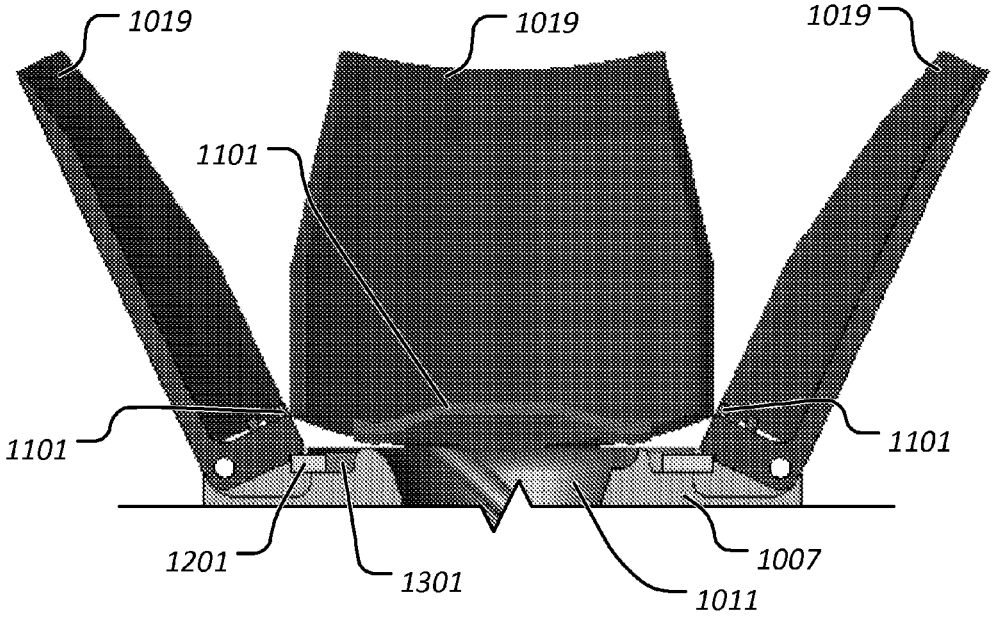
FIG. 13 is a cross-sectional view of an aft end of the grenade embodiment of FIG. 8, corresponding to the view of FIG. 10.

Furthermore, as shown in FIGS. 12 and 13, a spring ring 1201 is disposed in a groove 1301. Note that FIG. 13 is a cross-sectional view corresponding to the view of FIG. 10, wherein the view is enlarged and shows fins 1019 in their unfolded, deployed configuration. When fins 1019 have been biased by biasing elements 1101 to their fully unfolded, deployed configuration, as shown in FIG. 13, spring ring 1201 changes form to a larger diameter, abutting fins 1019 to retain fins 1019 in their unfolded, deployed configuration.

Returning again to FIG. 10, payload section 805 comprises a shell 1021, preferably comprising a plurality of pieces or a single piece that is frangible. The one or more penetrators 807 (only one labeled for clarity) are disposed in shell 1021. Payload section 805 further comprises a fuze 1023 extending from passageway 1017 defined by propellant housing 1007 to a charge 1025 that, in the illustrated embodiment, is proximate a nose 1027 of shell 1021. Fuze 1023 may, in some embodiments, comprise one or more of the materials and configurations discussed herein concerning fuzes 319, 321, and 323. As discussed herein, heat generated by the burning booster propellant 1009 propagates through passageway 1017 defined by propellant housing 1007 to activate payload section 805. Payload section 805 is activated when the heat propagating through passageway 1017 initiates fuze 1023, causing fuze 1023 to burn. When heat from the burning fuze 1023 reaches charge 1025, charge 1025 is initiated, causing shell 1021 to be compromised and fly away from the remainder of grenade 801. As the one or more penetrators 807 are no longer contained by shell 1021, penetrators 801 are dispersed from grenade 801. In the embodiment illustrated in the figures, nozzle 1011 is configured to impart a roll or spin in grenade 801 when grenade 801 is in flight. Such a roll or spin aids in stabilizing grenade 801 and imparts forces to help disperse penetrators 807.

Figure 14:
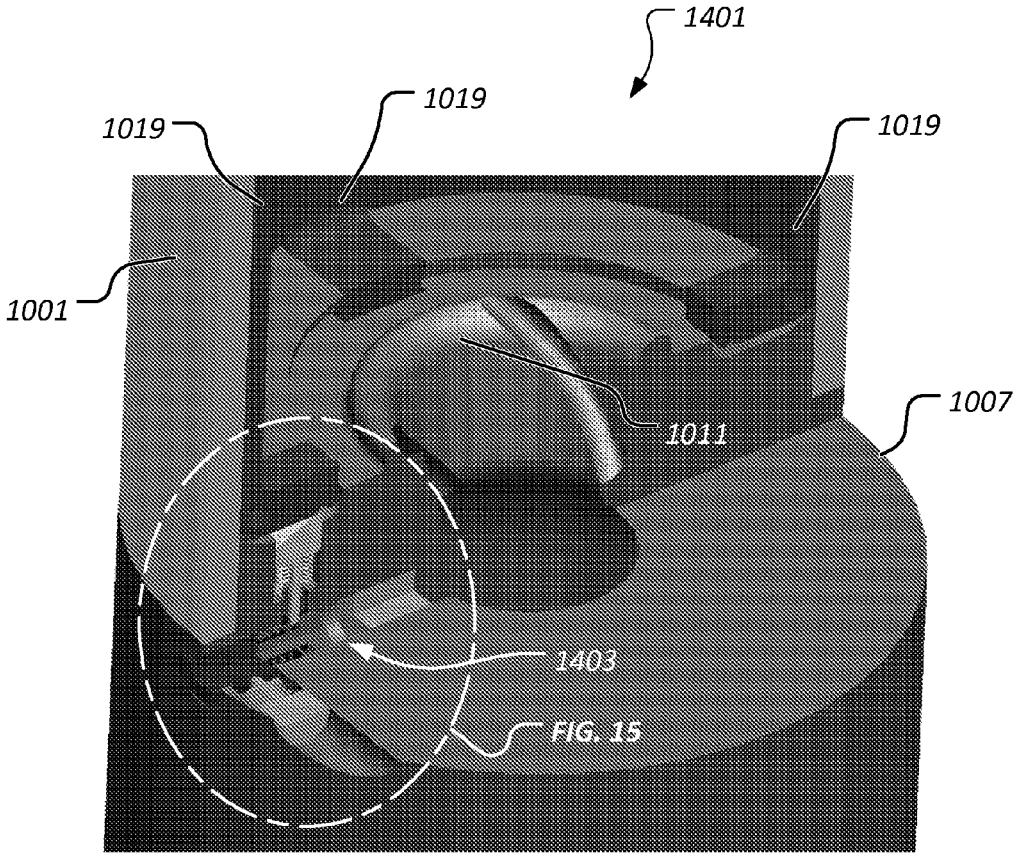
FIGS. 14 and 17 are a partial, cross sectional view of an aft portion of a grenade embodiment alternative to that of FIG. 8.
Figure 15:
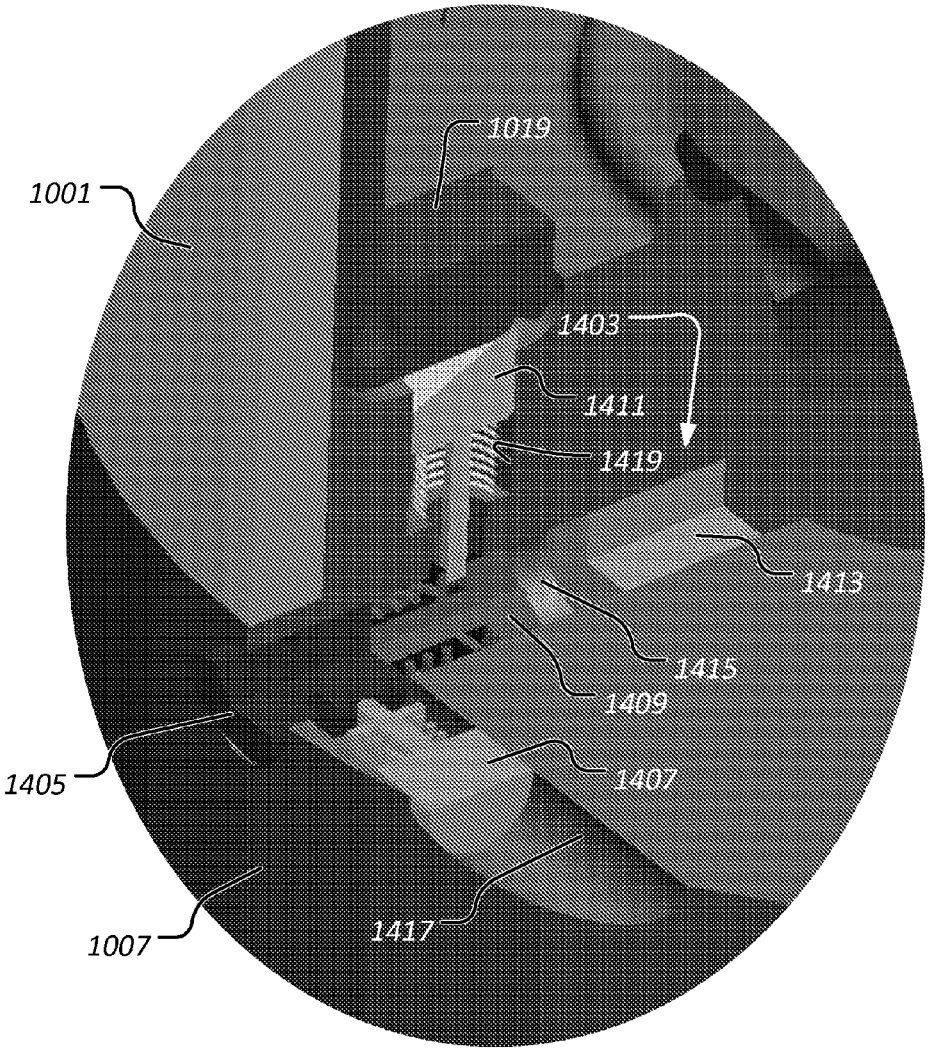
FIGS. 15, 16, and 18 are enlarged, partial cross-sectional views, corresponding to the views of FIGS. 14 and 17, illustrating an exemplary operation of a mechanical booster igniter.
Figure 16:
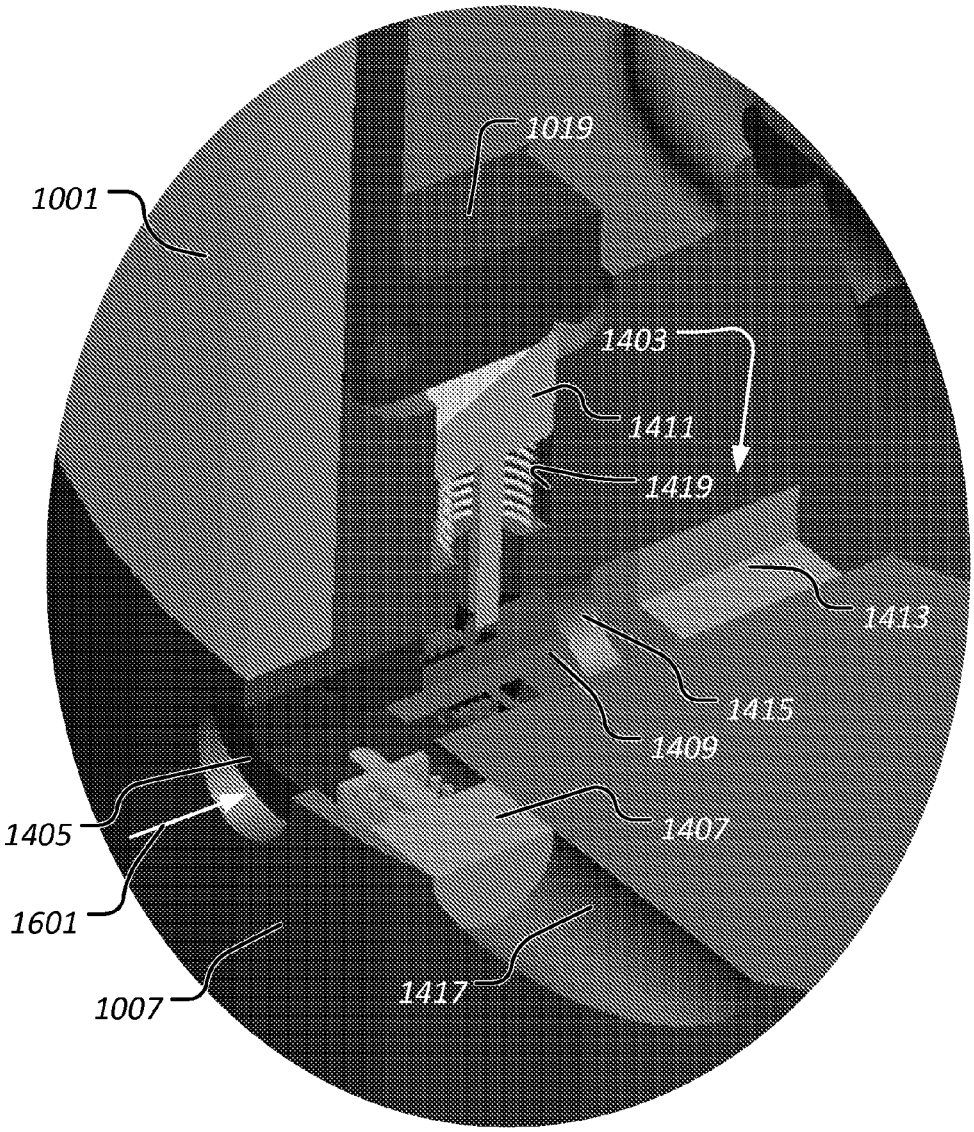
Figure 17:
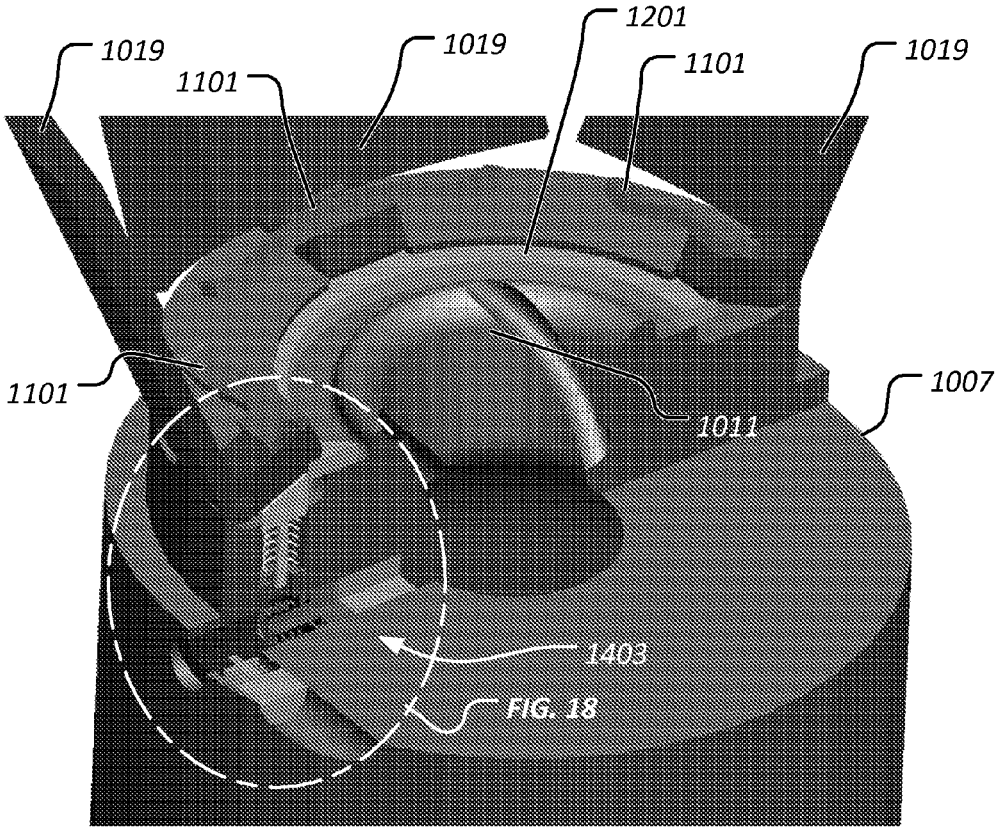
Figure 18:
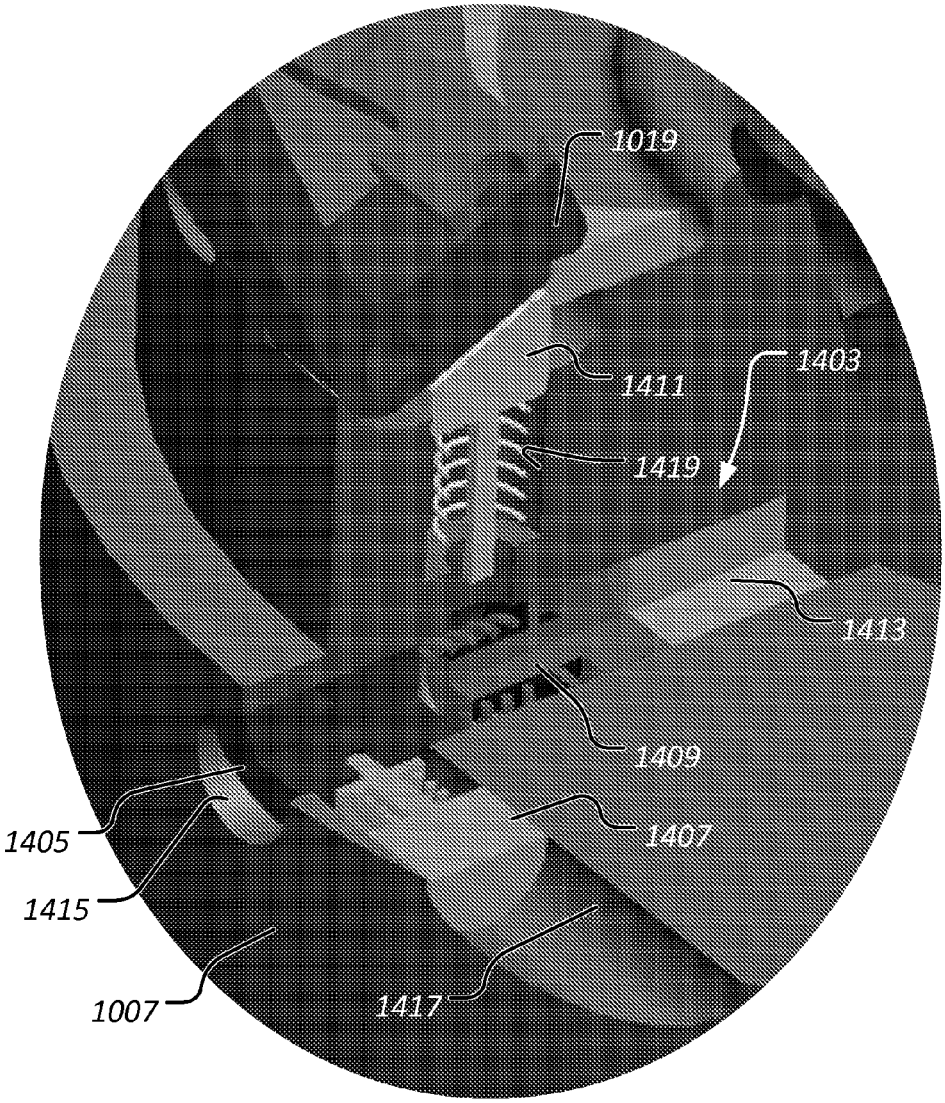

Alternatively, the present invention contemplates an embodiment wherein slow-burn igniter 1005 is replaced by a mechanical booster igniter. For example, FIG. 14 depicts a partial cross-sectional view of a portion of a grenade 1401. Specifically, FIG. 14 depicts a portion of casing 1001, portions of some of the fins 1019, a portion of booster propellant housing 1007, and mechanical booster igniter 1403. Note that in FIG. 14 biasing elements 1101 and spring ring 1201 are omitted for clarity. An enlarged view of mechanical booster igniter 1403, as indicated in FIG. 14, is shown in FIG. 15. Mechanical booster igniter 1403 comprises an arming pin 1405, a first spring-loaded locking pin 1407, a spring-loaded striker 1409, a second spring-loaded locking pin 1411, and a primer 1413. Arming pin 1405, striker 1409, and primer 1413 are disposed in a first bore 1415 defined by booster propellant housing 1007. First spring-loaded locking pin 1407 is disposed in a second bore 1417 defined by booster propellant housing 1007 that intersects first bore 1415. Second spring-loaded locking pin 1411 is disposed in a third bore 1419 defined by booster propellant housing 1007 that intersects first bore 1415. Moreover second spring-loaded locking pin 1411 abuts a portion of one of the plurality of fins 1019. Note that in FIG. 15 biasing elements 1101 and spring ring 1201 are omitted for clarity. In its initial configuration, shown in FIG. 15, mechanical booster igniter 1403 is configured such that first spring-loaded locking pin 1407 is compressed against, but not engaged with, arming pin 1405. Second spring-loaded locking pin 1411 is engaged with striker 1409 and compressed between fin 1019 and striker 1409. To begin the ignition sequence, as shown in FIG. 16, arming pin 1405 is advanced along bore 1415, generally in a direction corresponding to an arrow 1601, such that first spring-loaded locking pin 1407 becomes at least less compressed against arming pin 1405 and is engaged with arming pin 1405. In one embodiment, the movement of arming pin 1405 is induced by an element of a grenade launcher in which grenade 1401 is disposed for firing. Note that in FIG. 16 biasing elements 1101 and spring ring 1201 are omitted for clarity. Next in the ignition sequence, shown in FIG. 17, grenade 1401 is fired using firing charge 1003 (shown in at least FIG. 13), causing casing 1001 to separate from the remainder of grenade 1401, which allows the plurality of fins 1019 to pivot to their unfolded, deployed configurations. FIG. 18 depicts an enlarged view of mechanical booster igniter 1403 corresponding to the views of FIGS. 15 and 16. As fin 1019 pivots to its unfolded, deployed configuration, second spring-loaded pin 1411 becomes disengaged from striker 1409, allowing striker 1409 to impact primer 1413, thus igniting primer 1413 and booster propellant 1009. Other elements of grenade 1401, as well as the operation of such elements, are generally equivalent to corresponding elements of grenade 801.

Figure 19:
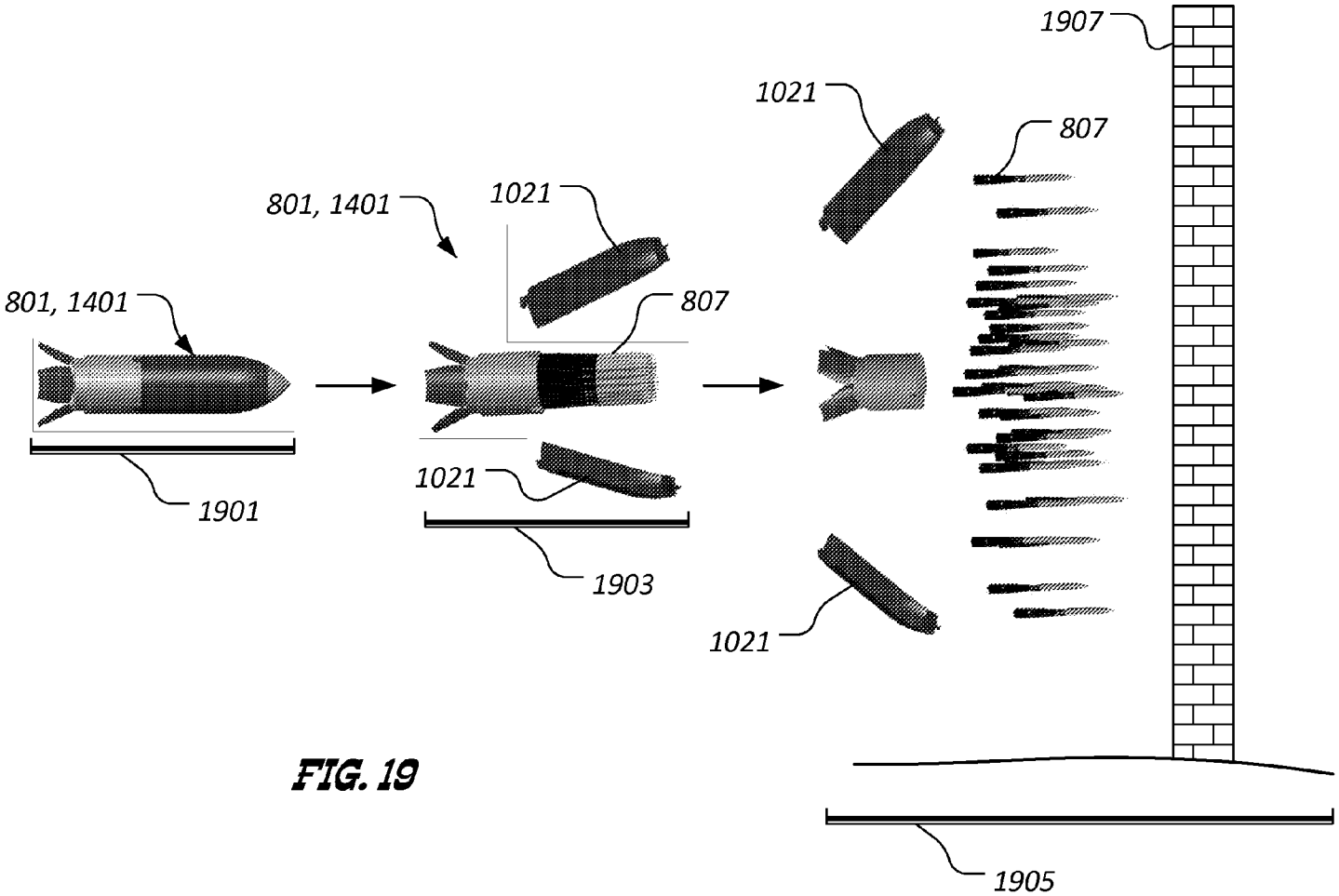
FIG. 19 is a stylized view illustrating an exemplary operation of the grenade embodiments of FIGS. 8-18.

FIG. 19 depicts an exemplary operation of grenade 801, 1401, or the equivalent. As discussed in detail herein, the as-fired grenade (shown generally at 1901) travels through the air until charge 1025 (shown in FIG. 10) is initiated, wherein shell 1021 is compromised and flies away from the remainder of grenade 801 or 1401 (shown generally at 1903). Penetrators 807 (only one labeled for clarity) are now unconstrained and, thus, are deployed, wherein penetrators 801 strike a wall 1907 to breach wall 1907 (shown generally at 1905).

The present invention provide significant advantages including, but not limited to, (1) providing a grenade capable of temporarily visually impairing opposing combatants or other unruly persons; (2) providing a grenade capable of marking persons involved in riot or violent confrontations; and (3) providing a grenade capable of breaching a wall, such as a wall of a building.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below. It is apparent that an invention with significant advantages has been described and illustrated. Although the present invention is shown in a limited number of forms, it is not limited to just these forms, but is amenable to various changes and modifications without departing from the spirit thereof.

What is claimed is:

1. A rocket-propelled grenade, comprising:

a propulsion section comprising a booster propellant housing defining a nozzle and a groove;

a payload section operably associated with the propulsion section and joined to the booster propellant housing, the payload section comprising:

a shell;

one or more penetrators disposed in the shell; and a charge for compromising the shell to deploy the one or more penetrators when the charge is initiated;

a plurality of fins operably associated with the booster propellant housing;

a plurality of biasing elements, corresponding to the plurality of fins, operably associated with the plurality of fins for biasing the plurality of fins to an unfolded configuration; and a spring ring disposed in the groove, such that the spring ring changes shape when the plurality of fins is deployed to lock the plurality of fins in a deployed configuration.

2. The rocket-propelled grenade of claim 1, wherein the propulsion section comprises:
a casing joined to the booster propellant housing;
a firing charge disposed at an aft end of the casing;
a booster propellant disposed in the booster propellant housing; and
a slow-burn igniter disposed in the nozzle of the booster propellant housing.

3. The rocket-propelled grenade of claim 2, wherein the nozzle is configured to impart a roll or spin to the rocket-propelled grenade when in flight.

4. The rocket-propelled grenade of claim 1, wherein the propulsion section comprises:
a casing joined to the booster propellant housing;
a firing charge disposed at an aft end of the casing;
a booster propellant disposed in the booster propellant housing; and
a mechanical booster igniter operably associated with the booster propellant.

5. The rocket-propelled grenade of claim 4, further comprising;
a plurality of fins, wherein the mechanical booster igniter comprises:
an arming pin;
a first spring-loaded locking pin engageable with the arming pin;
a spring-loaded striker operably associated with the arming pin;
a second spring-loaded locking pin operably associated with the spring-loaded striker and a fin of the plurality of fins; and
a primer operably associated with the spring-loaded striker.

6. The rocket-propelled grenade of claim 2, wherein the casing defines one or more ports between the firing charge and the slow-burn igniter.

7. The rocket-propelled grenade of claim 6, wherein the slow-burn igniter is configured to ignite the booster propellant.

8. The rocket-propelled grenade of claim 7, wherein the booster propellant housing defines a passageway therein that is configured to propagate heat generated from the ignited booster propellant to activate the payload section.

9. The rocket-propelled grenade of claim 6, wherein the firing charge is configured to produce rapidly expanding gases to thereby cause the casing to separate from the booster propellant housing and initiate the slow-burn igniter.

10. A rocket-propelled grenade, comprising:
a propulsion section, comprising:
a booster propellant housing;
a casing joined to the booster propellant housing;
a firing charge disposed at an aft end of the casing;
a booster propellant disposed in the booster propellant housing; and
a mechanical booster igniter operably associated with the booster propellant;
a payload section operably associated with the propulsion section and joined to the booster propellant housing, the payload section comprising:
a shell;
one or more penetrators disposed in the shell; and
a charge for compromising the shell to deploy the one or more penetrators when the charge is initiated;
a plurality of fins, wherein the mechanical booster igniter comprises:
an arming pin;
a first spring-loaded locking pin engageable with the arming pin;
a spring-loaded striker operably associated with the arming pin;
a second spring-loaded locking pin operably associated with the spring-loaded striker and a fin of the plurality of fins; and
a primer operably associated with the spring-loaded striker.

* * * * *